US006959566B2

(12) United States Patent
Zorini et al.

(10) Patent No.: US 6,959,566 B2
(45) Date of Patent: Nov. 1, 2005

(54) TEXTILE MACHINE AND CONTROL METHOD THEREOF

(75) Inventors: Luigi Omodeo Zorini, c/o Comez S.p.A. - Via Enrico Fermi, 5 -P.O. Box 5, 27024 Cilavegna (Pavia) (IT); Pierantonio Franchino, Robbio (IT)

(73) Assignee: Luigi Omodeo Zorini, Cilavegna (IT)

( * ) Notice: Subject to any disclaimer, the term of this patent is extended or adjusted under 35 U.S.C. 154(b) by 0 days.

(21) Appl. No.: 10/949,862

(22) Filed: Sep. 24, 2004

(65) Prior Publication Data

US 2005/0066693 A1 Mar. 31, 2005

(30) Foreign Application Priority Data

Sep. 30, 2003 (EP) ..... 03425640

(51) Int. Cl.[7] ..... D04B 23/22
(52) U.S. Cl. ..... 66/204
(58) Field of Search ..... 66/203–207, 214

(56) References Cited

U.S. PATENT DOCUMENTS 4,430,870 A 2/1984 Winter et al.
4,487,039 A 12/1984 Mayer et al.
4,614,095 A * 9/1986 Porat ..... 66/207
4,835,990 A 6/1989 Zorini et al.
5,327,750 A * 7/1994 Speich ..... 66/207
5,375,435 A 12/1994 Gille et al.
5,502,987 A * 4/1996 Zorini ..... 66/207
5,709,108 A * 1/1998 Ono et al. ..... 66/205
6,209,362 B1 * 4/2001 Speich ..... 66/207

FOREIGN PATENT DOCUMENTS

DE 44 39 907 A1 5/1996

* cited by examiner

*Primary Examiner*—Danny Worrell
(74) *Attorney, Agent, or Firm*—Pearne & Gordon LLP

(57) ABSTRACT

A textile machine comprising a needle bar (6) carrying a plurality of needles (7), a guide bar (8) carrying a plurality of eye-pointed needles (9) and at least one carrier slide bar (10) carrying a plurality of threading tubes (11); the machine (1) further comprises a main shaft (12) for a synchronised movement of the bars (6, 7, 8) and manufacture of a textile product (5), a first feeding member (20) to feed at least one weft yarn (19) to said threading tubes (11), a second feeding member (40) to feed a plurality of warp yarns (18) to said eye-pointed needles (9) and a take-down member (60) to draw said textile product (5). The machine (1) is also provided with a control apparatus (80) comprising at least one first electromechanical actuator (30), operatively active on said first or second feeding members (20, 40) or on said take-down member (60) for movement of same and a controller (90) for regulation of at least said first actuator (30).

34 Claims, 5 Drawing Sheets

TEXTILE MACHINE AND CONTROL METHOD THEREOF

FIELD AND BACKGROUND OF THE INVENTION

The present invention relates to a textile machine and the control method thereof.

It is known that in textile machines, such as crochet machines for warp knitting workings, also referred to as crochet galloon looms, formation of the woven product takes place by mutual interlacing, following preestablished patterns, of a plurality of warp and weft yarns, suitably engaged by respective knitting members; said knitting members are for example needles mounted on a needle bar, eye-pointed needles supported by a guide bar and threading tubes mounted on one or more carrier slide bars.

These knitting members are operated by appropriate actuators, with synchronized cyclic movements, to cause mutual interlacing of the warp and weft yarns following the desired knitting pattern.

The weft and warp yarns are fed to the respective knitting members by a plurality of bobbins mounted on a rack-shaped structure called "unwinding creel", or they are unwound from a drum called "beam".

It is also provided that appropriate take-down rollers should cause sliding of the textile product and progressive supply of same to the machine exit.

The bobbins on which the weft yarns are wound are free to rotate about their longitudinal rotation axis, and the tension with which the weft yarns are fed to the carrier slide bar is determined by the rotation speed of the rollers that are interposed between the unwinding creel and the carrier slide bar and are disposed close to each other so as to engage the weft yarns.

Rotation of these rollers is usually caused by a kinematic connection between said rollers and the main shaft of the textile machine; since this connection is of a purely mechanical type, it keeps a fixed position during production of the whole fabric.

Therefore, irrespective of the amount of the longitudinal translations of each individual carrier slide bar (and of the related threading tubes), the amount of weft yarn supplied to each tube in the time unit is constant over the whole production cycle of the textile product. This means that each threading tube receives the same amount of weft yarn both when it is moved so as to jump over a single needle and when it jumps over several needles (e.g. 3–5 needles).

The kinematic connection between the main shaft and the rollers interposed between the unwinding creel and the carrier slide bar is obtained in such a manner that said rollers supply the threading tubes with an amount of yarn that is intermediate between the amount of yarn necessary to a threading tube when a minimum displacement thereof takes place and the required amount of yarn during the tube maximum displacement.

It is apparent that, taking into account the above described structure and the respective operation modalities, the fabric that is obtained will not be able to have excellent aesthetic features, since the same amounts of weft yarn are employed to make weft rows having different lengths from each other.

Likewise, the warp yarns too are fed to the guide bar through rollers disposed suitably close to each other, and the finished product is picked up from the front grooved bar by means of a quite similar roller member.

Both the feeding member of the warp yarns and the take-down member of the textile product are mechanically connected to the main shaft so that the follow-up ratio (i.e. the ratio between the number of revolutions carried out in the time unit by the feeding/take-down rollers and the number of revolutions carried out in the time unit by the main shaft) keeps constant over the whole working of the textile product.

Consequently, it is not possible to alter tensioning of the weft and warp yarns when supplied to the respective bars without stopping operation of the machine, neither is it possible to modify the pulling tension applied when the finished product is removed from the front grooved bar.

Therefore, by adopting these modalities of use of the loom it is not possible to alter the fabric compactness or density both in a transverse direction and in a direction parallel to the extension of the textile product, without stopping operation of the machine.

In addition, exactly due to the fact that the warp and weft yarns are fed to the eye-pointed needles and the threading tubes with a constant tension and the textile product is caused to slide between the take-down rollers with a constant tension in time it is not possible to obtain particular aesthetic effects through a controlled variation of the fabric compactness, without stopping operation of the machine, said aesthetic effects comprising alternations of thinner and more compact regions, narrowing or shrinkage of the textile product along a direction substantially perpendicular to the movement direction in which the textile product itself is moved by the take-down rollers, etc.

SUMMARY OF THE INVENTION

The present invention aims at solving the above mentioned drawbacks.

In particular, it is an aim of the present invention to make available a textile machine and the control method of same that are able to alter tensioning at which the weft yarns are fed to the carrier slide bars depending on the displacements of said carrier slide bars, without stopping operation of the machine.

Another aim of the present invention is to make available a textile machine and the control method thereof that are able to alter tensioning at which the warp yarns are fed to the guide bar, without stopping operation of the machine.

It is a further aim of the invention to provide a textile machine and the control method thereof that allow the pulling tension of the textile product coming out of the machine to be varied, without stopping operation of the machine.

A still further aim of the invention is to provide a textile machine and the control method thereof enabling articles of manufacture having portions of different compactness in a direction both parallel and transverse to the extension of the product itself to be made in an automatic manner.

The foregoing and still further aims are substantially achieved by a textile machine and the control method thereof, having the features set out in the appended claims.

BRIEF DESCRIPTION OF THE DRAWINGS

Further features and advantages will become more apparent from the detailed description of a preferred embodiment of a textile machine and the control method thereof given by way of non-limiting example and illustrated in the accompanying drawings, in which.

DESCRIPTION OF THE PREFERRED EMBODIMENT

Figure 1:
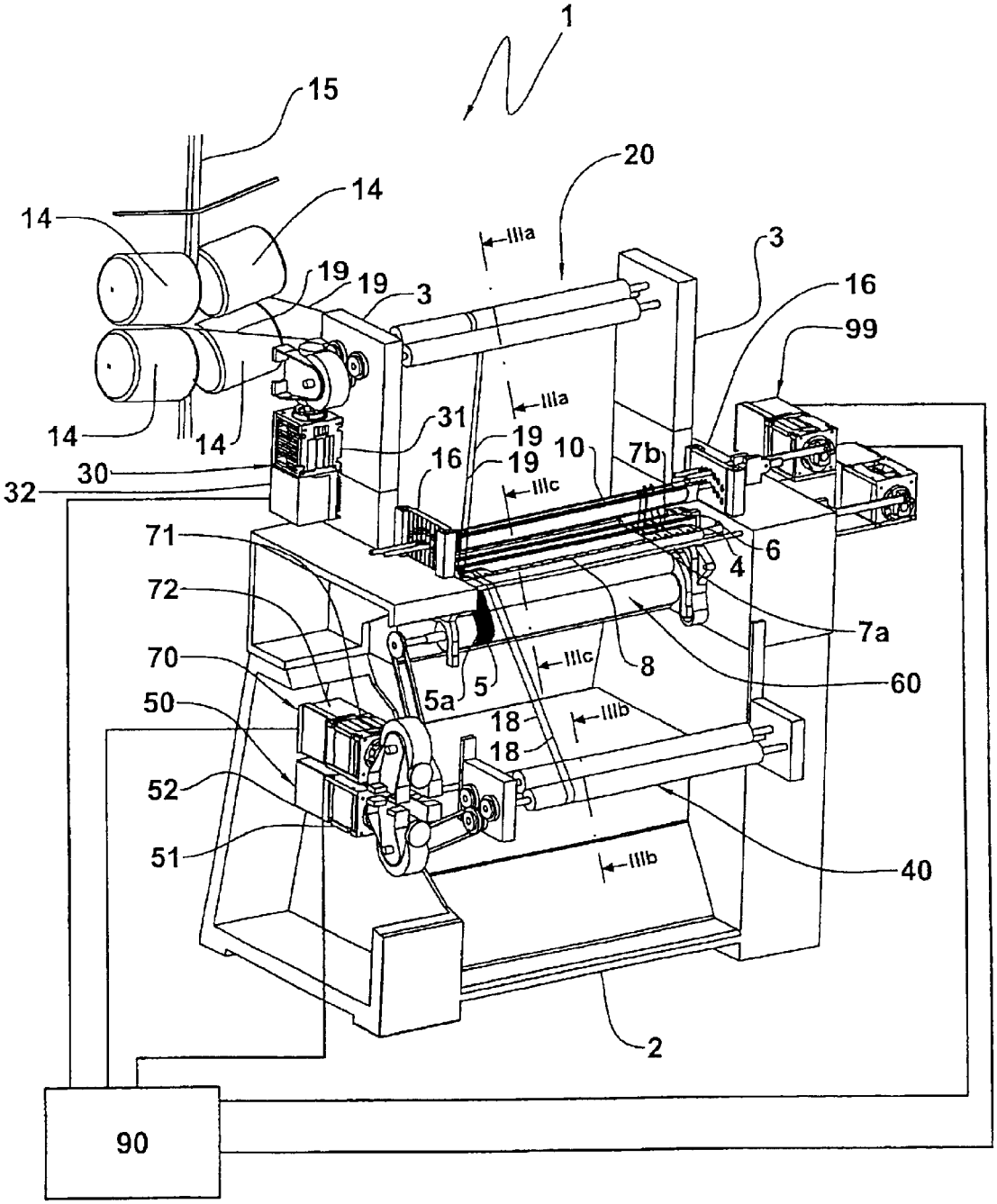
FIG. 1 is a partly diagrammatic perspective view of a textile machine in accordance with the present invention.

With reference to the drawings, a textile machine in accordance with the present invention has been generally identified by reference numeral 1.

The textile machine 1 that is preferably a crochet machine for warp knitting workings comprises a bed 2 provided with two side standards 3, between which at least one front grooved bar 4 horizontally extends, wherein sequential interlacing of the knitting yarns takes place for manufacturing a textile product 5.

Also arranged between the side standards 3 is a needle bar 6 supporting a plurality of needles 7; said needles are consecutively aligned with each other along bar 6 and are included between a first needle 7*a* and a second needle 7*b*.

Figure 2:
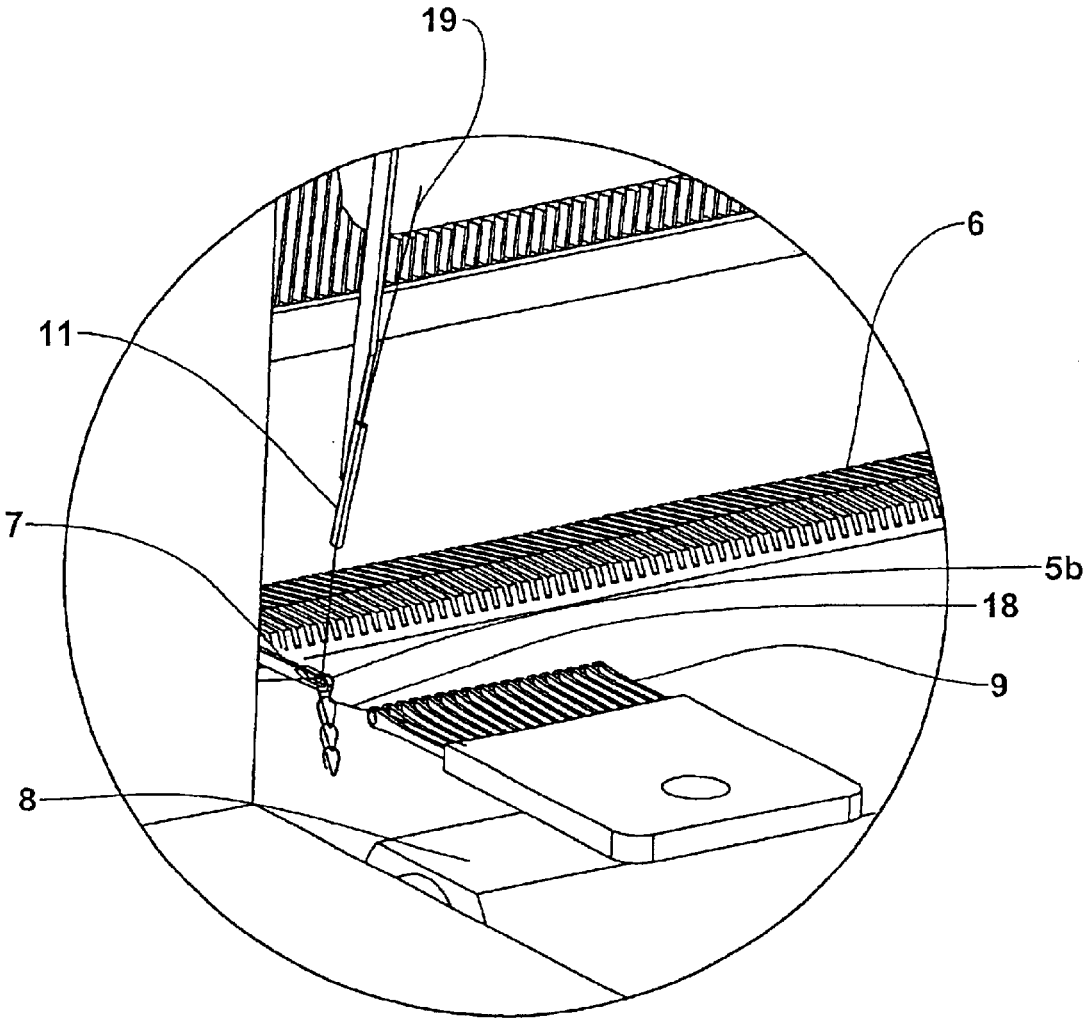
FIG. 2 shows a detail of the machine in FIG. 1.

Referring particularly to FIG. 2, the first needle 7*a* is the first needle starting from the right, whereas the second needle 7*b* is the first needle starting from the left; for the sake of simplicity other needles are supposed to be present at the right of the first needle 7*a* or at the left of the second needle 7*b*.

The needle bar 6 moves needles 7 along a direction substantially parallel to the longitudinal extension of the latter and perpendicular to the extension of the front grooved bar 4.

Also mounted between the side standards 3 is a warp yarn guide bar or more simply "guide bar" 8 bearing a plurality of eye-pointed needles 9 and actuating the latter along arched trajectories, on either side of needles 7, to obtain warp chains of said textile product 5.

The warp yarns 18, each of which is in engagement with a respective eye-pointed needle 9, are wound around a beam from which they are progressively unwound during manufacture of the textile product 5.

The textile machine 1 further comprises at least one carrier slide bar 10, on which a plurality of threading tubes 11 are mounted; the carrier slide bar 10 is submitted both to a reciprocating motion in a vertical direction through appropriate lifting plates 16 with which the ends of said carrier slide bar 10 are in engagement, and to a horizontal movement in a direction substantially parallel to its longitudinal extension.

In this way, the weft yarns 19 guided by said threading tubes 11 are interlooped with the warp chains obtained through a mutual motion of the needles 7 and eye-pointed needles 9, thereby making the textile product 5.

Therefore, the textile product 5 is defined by an orderly succession of rows of weft yarn 19, interlooped with the chains obtained from the warp yarns 18; for the sake of simplicity, in the present context each row of weft yarns will be referred to as "weft row".

The movements of said bars 6, 8 and 10 will not be further described as they are of known type.

Each weft yarn 19 is wound around a corresponding bobbin 14, mounted on a unwinding creel 15 and is progressively fed to a corresponding threading tube 11 to manufacture the textile product 5; in an alternative embodiment, not shown in the accompanying drawings, the weft yarns 19 are unwound from a beam.

Interposed between the bobbins 14 of the unwinding creel 15 and the carrier slide bar 10 is a first feeding member 20, to feed the respective weft yarn 19 to each threading tube 11.

In the preferred embodiment the first feeding member comprises a first roller 21, a second roller 22 disposed close to the first roller 21 and a third roller 23 disposed close to the second roller 22.

The first roller 21 has a first bearing arc 21*a* with which the weft yarn 19 is in engagement during feeding of same to the threading tube 11; the first bearing arc 21*a* has a first end 21*b* and a second end 21*c* delimiting the roller portion on which the weft yarn 19 rests.

Likewise, the second roller 22 has a second bearing arc 22*a* having a first end 22*b* and a second end 22*c*; the third roller 23 has a third bearing arc 23*a* with at least one first end 23*b*.

Figure 3A:
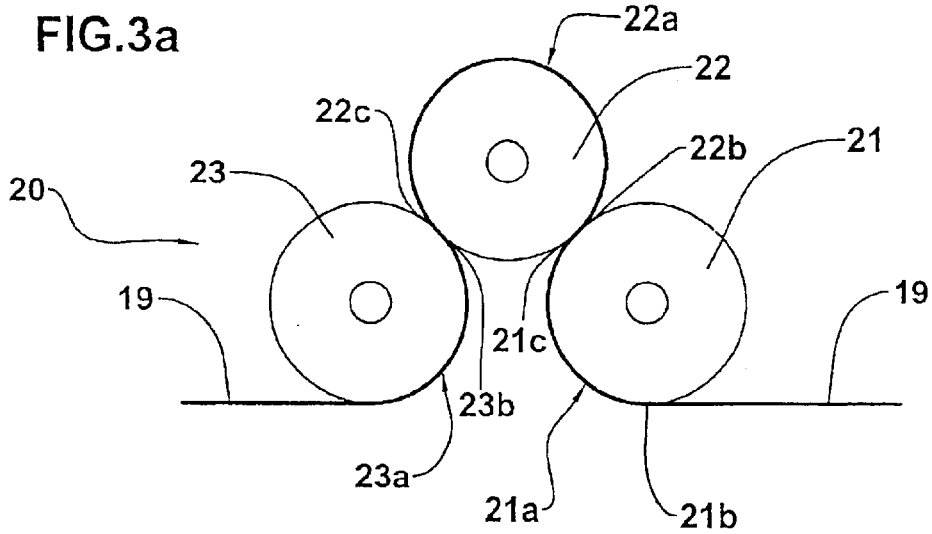
FIG. 3*a* diagrammatically shows a section taken along line IIIa—IIIa of the machine in FIG. 1.

Preferably, as shown in FIG. 3*a*, rollers 21, 22 and 23 are disposed close to each other so that the second end 21*c* of the first bearing arc 21*a* is coincident with the first end 22*b* of the second arc 22*a*, and the second end 22*c* of the second bearing arc 22*a* is coincident with the first end 23*b* of the third arc 23*a*.

A first electromechanical actuator 30 is connected with the first feeding member 20 to drive said rollers 21, 22 and 23 in rotation and supply the threading tube 11 with the respective weft yarn 19 at a given tension that, as better clarified in the following, can be altered during manufacture of the textile product 5.

In more detail, the first electromechanical actuator is made up of an electric motor 31, preferably a brushless motor, and of an electric activation device 32 for powering and controlling motor 31.

The electric motor 31 is provided with an output shaft 33 that, when powered by said activation device 32, is driven in rotation.

The output shaft 33 is connected with the first and preferably the third rollers, 21, 23, of the first feeding member 20, whereas the second roller 22 is idly mounted on a respective rotation axis; therefore by varying the rotation speed of the output shaft 33 it is possible to regulate tensioning of the weft yarn 19 when supplied to the threading tube 11.

A second feeding member 40 is interposed between the beam and the guide bar 6 to supply the latter with the warp yarns 18.

Figure 3B:
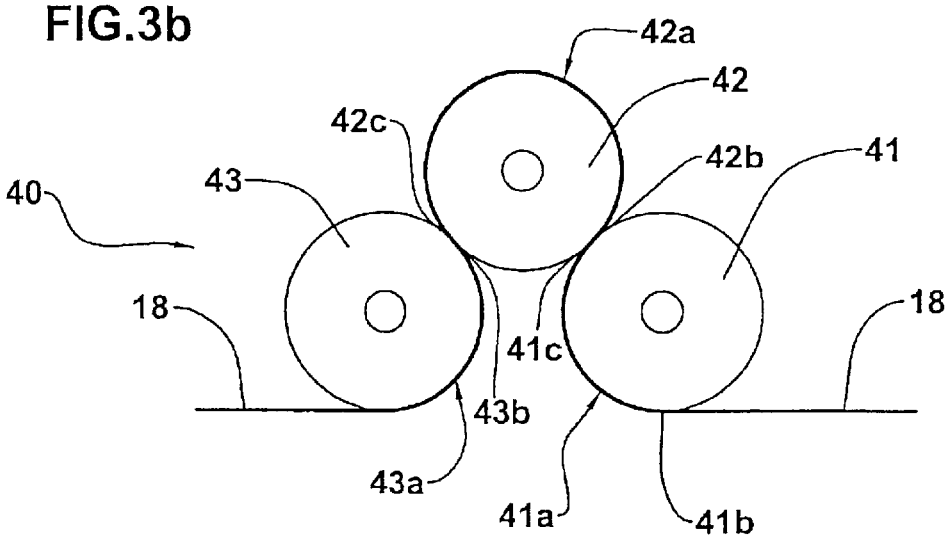
FIG. 3*b* diagrammatically shows a section taken along line IIIb—IIIb of the machine in FIG. 1.

The second feeding member 40 (FIG. 3*b*) is made up of a first roller 41, a second roller 42 and a third roller 43; the first roller 41 has a first bearing arc 41*a* for the warp yarns 18 delimited by a first and a second ends 41*b*, 41*c*.

The second roller 42 has a second bearing arc 42*a* delimited by a first and a second ends 42*b*, 42*c*; the third roller 43 has a third bearing arc 43*a* having at least one first end 43*b*.

Conveniently, the first, second and third rollers 41, 42, 43 are disposed close to each other so that the second end 41*c* of the first bearing arc 41*a* is coincident with the first end 42*b* of the second bearing arc 42*a*, and the second end 42*c* of the second bearing arc 42*c* is coincident with the first end 43*b* of the third bearing arc 43*a*.

A second electromechanical actuator 50 is connected with the second feeding member 40, to drive said rollers 41, 42, 43 in rotation and supply the eye-pointed needles 9 with the respective warp yarns 18 at a given tension that, as will be better clarified in the following, can be altered during manufacture of the textile product 5.

In more detail, the second electromechanical actuator 50 is made up of an electric motor 51, preferably a brushless motor, and of an electric activation device 52 for powering and controlling motor 51.

The electric motor 51 is provided with an output shaft 53 that, when powered by said activation device 52, is driven in rotation.

The output shaft 53 is connected with the first and preferably the third rollers 41, 43 of the second feeding member 40, whereas the second roller 42 is idly mounted on a respective rotation axis; by altering the rotation speed of the output shaft 53 it is therefore possible to regulate tensioning of the warp yarns 18 when supplied to the eye-pointed needles 9.

A take-down member 60 is positioned close to the front grooved bar 4, to engage the textile product 5 and draw it to the exit of machine 1.

Figure 3C:
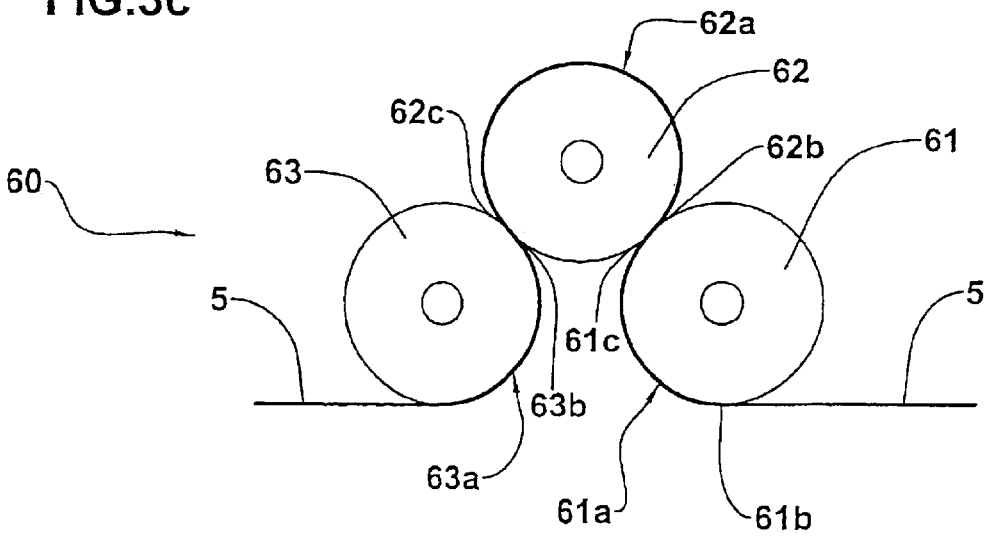
FIG. 3*c* diagrammatically shows a section taken along line IIIc—IIIc of the machine in FIG. 1.
Figure 4:
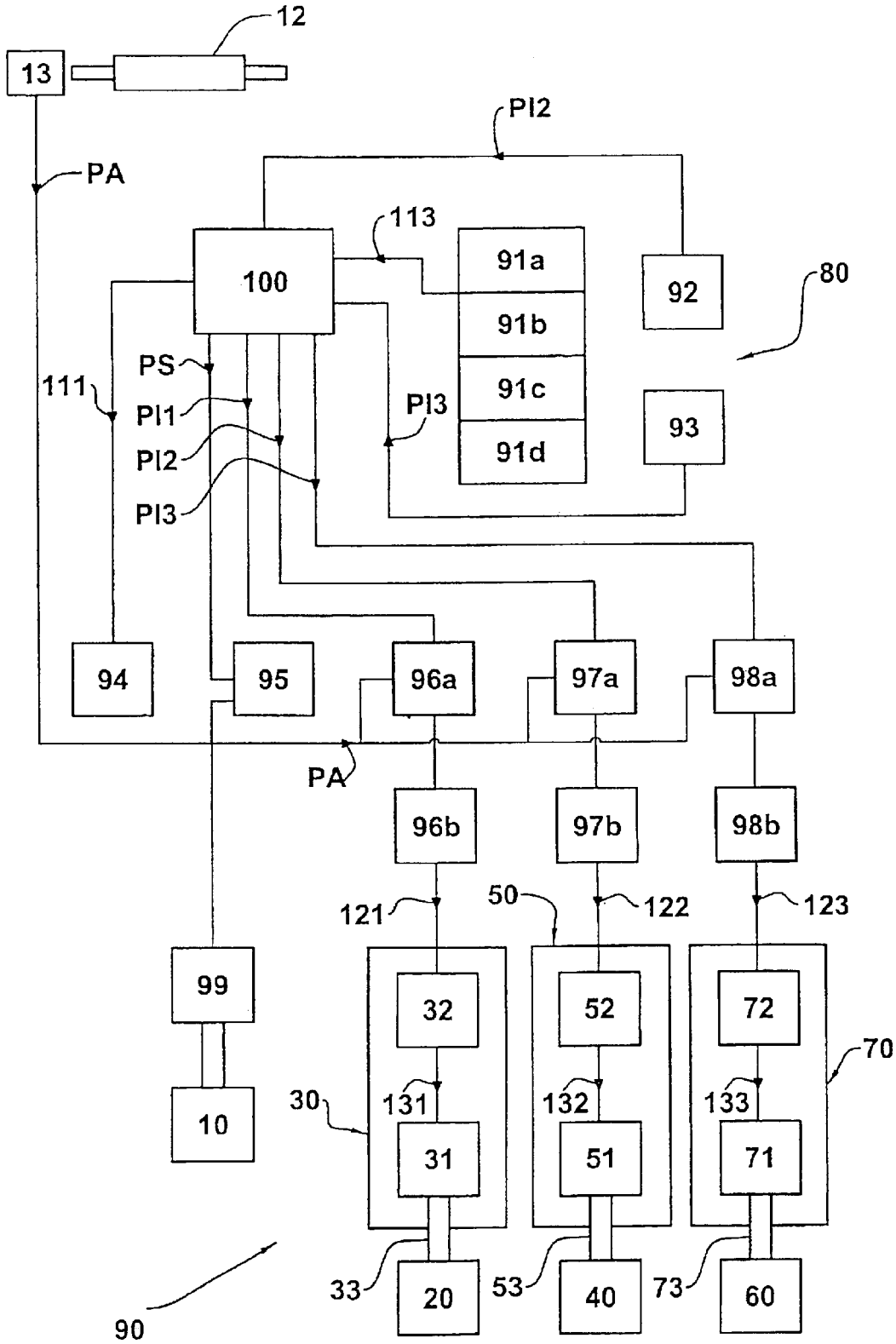
FIG. 4 is a block diagram of the machine in FIG. 1.
Figure 5:
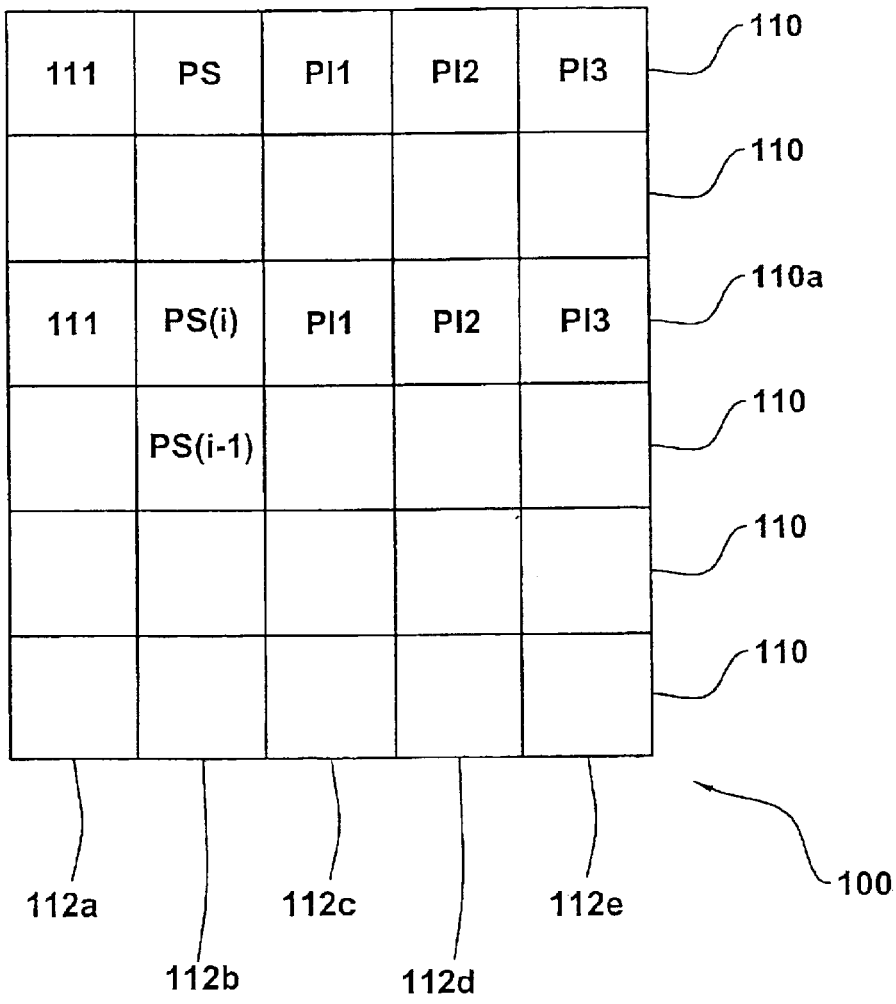
FIG. 5 diagrammatically shows the logic structure of a memory employed in the machine in FIG. 1.

The take-down member 60 (FIG. 3*c*) consists of a first roller 61, a second roller 62 and a third roller 63; the first roller 61 has a first bearing arc 61*a* for the textile product 5 having a first and a second ends 61*b*, 61*c*.

The second roller 62 has a second bearing arc 62*a*, delimited by a first and a second ends 62*b*, 62*c*; the third roller 63 has a third bearing arc 63*a* having at least one first end 63*b*.

Conveniently, the first, second and third rollers 61, 62, 63 are disposed close to each other so that the second end 61*c* of the first bearing arc 61*a* is coincident with the first end 62*b* of the second bearing arc 62*a*, and the second end 62*c* of the second bearing arc 62*a* is coincident with the first end 63*b* of the third bearing arc 63*a*.

A third electromechanical actuator 70 is connected with the take-down member 60, to drive said rollers 61, 62, 63 in rotation and draw the textile product 5 according to a given tensioning that, as better clarified in the following, can be varied during manufacture of the textile product 5.

In more detail, the third electromechanical actuator 70 is made up of an electric motor 71, preferably a brushless motor, and of an electric activation device 72 for powering and controlling motor 71. The electric motor 71 is equipped with an output shaft 73 that is driven in rotation depending on the power amount supplied by said activation device 72.

The output shaft 73 is connected with the first and preferably the third rollers 61, 63 of the second feeding member 60, whereas the second roller 62 is idly mounted on a respective rotation axis; by varying the rotation speed of the output shaft 73 it is therefore possible to regulate the pulling tension of the textile product 5. It will be appreciated that motors 31, 51 and 71 can be either brushless motors or stepping motors.

The textile machine 1 further comprises a main shaft 12 driven in rotation by appropriate actuating means (not shown in the drawings) preferably comprising an electric motor.

The main shaft 12 is used to provide a reference to the synchronized movement of the different members of which the textile machine is made; in fact, the needle bar 6, guide bar 8 and carrier slide bar 10 directly or indirectly derive their position and movement speed from the angular position PA and the rotation speed of the main shaft 12.

Connection between the main shaft 12 and bars 6, 8, can be of an exclusively mechanical type, consisting of appropriate intermediate kinematic mechanisms; alternatively, the angular position PA of the main shaft 12 can be detected by a sensor 13 (an encoder, for example) so that a control of the electronic type active on electromechanical actuators connected with said bars 6, 8, 10 can keep the bars 6, 8, 10 synchronised with the main shaft 12.

As will be apparent in the following, also the movement of the feeding members 20, 40 and take-down member 60 is synchronised with the rotation of the main shaft 12.

In order to control the whole operation of the machine 1 and the members of which it is comprised, the machine 1 is equipped with a control apparatus 80 that, in addition to said first, second and third electromechanical actuators 30, 50, 70, also comprises a controller 90.

Controller 90 is first of all provided with a memory 100 on which the necessary parameters for regulating operation of the machine 1 are stored.

In more detail, memory 100 contains a plurality of records 110, each of which is associated with a respective weft row 5*b* of the textile product; records 110 are then disposed in an orderly sequence corresponding to the sequence of the weft rows 5*b* of the textile product 5.

Each record 110 consists of a plurality of fields, each of which is designed to contain a respective operation parameter of a device of the machine 1.

A first field 112*a* contains a main parameter 111, representative of the weft row 5*b* corresponding to record 110; the main parameter 111 is conveniently a progressive numeric code: record 110 having the main parameter 111 equal to "1" corresponds to the first weft row 5*b* that is made, the record having the main parameter equal to "2" corresponds to the second weft row 5*b* that is made.

A second field 112*b* of record 110 contains a displacement parameter PS, representative of a longitudinal displacement of the carrier slide bar 10 carried out to make the weft row 5*b* associated with record 110; the movement width of the carrier slide bar in fact is varied during manufacture of the textile product 5 to obtain particular geometries or decorations thereon, and the displacement parameters PS represent the amount of these displacements.

A third field 112*c* of record 110 contains a first follow-up parameter PI1, associated with the weft row 5*b* corresponding to said record 110, and representative of a follow-up ratio between the output shaft 33 of motor 31 of the first electromechanical actuator 30 and the main shaft 12.

The first follow-up parameter PI1 is determined, row by row, so as to continuously adjust the follow-up ratio between the output shaft 33 of motor 31 of the first electromechanical actuator 30 and the main shaft 12.

For the purpose, controller 90 is equipped with first calculation means 91 to calculate the first follow-up parameter PI1 depending on the displacement parameter PS belonging to the same record 110; in fact it is important that the amount of the weft yarn 19 supplied by the first feeding member 20 to the threading tube 11 should be suitably adjusted depending on the displacements carried out by the carrier slide bar 10.

Referring particularly to a predetermined record 110*a*, the first follow-up parameter PI1 is proportional to a factor defined by the sum of a first and a second parameters PAR1, PAR2.

The first parameter PAR1 is a function of the first displacement parameter PS (i) belonging to the preestablished second 110*a* and in turn obtained from the sum of a first addend ADD1 and a second addend ADD2. The first addend ADD1 reveals the difference between the first displacement parameter PS(i) belonging to record 110*a* and the displacement parameter PS(i−1) belonging to the preceding record 110 with respect to said record 110*a*; the second addend ADD2 is proportional to the difference between the displacement parameter PS(i) and a parameter PPOS1 or PPOS2 defining the position of the first or the second needle 7*a*, 7*b*.

In other words, the first addend ADD1 states the displacement amount of the carrier slide bar 10 between the weft row 5*b* associated with record 110*a* and the preceding one, whereas the second addend ADD2 states the distance between the position taken by the carrier slide bar 10 following the displacement defined by the displacement parameter PS(i), and the position of the first needle 7*a* (if the displacement took place to the right) or the second needle 7*b* (if the displacement took place to the left).

The first addend ADD1 therefore represents the space traveled over by the threading tube 11 during displacement thereof from a weft row 5*b* to the subsequent one; the second addend ADD2 on the contrary represents the distance separating the final position of the carrier slide bar 10 (defined through the position of a single reference threading tube) from the position of the last needle 7. As above mentioned, said last needle 7 will be the first needle 7*a*, when displacement of bar 10 takes place to the right, or the second needle 7*b* in case of displacement to the left.

It will be appreciated that movement of the carrier slide bar 10 going beyond the last needle 7*a*, 7*b* that is physically available on the needle bar 6, allows particular effects to be obtained at the side edges 5*a* of the textile product 5, which effects are exactly due to the presence of an excess weft yarn 19.

The parameters PPOS representative of the position of the first and second needles 7*a*, 7*b* are inputted at the beginning of the machine working and they too are stored in an appropriate storage register 100.

The second parameter PAR2 contributing to the definition of the first follow-up parameter PI1 depends on the speed at which the textile product 5 is drawn by the take-down member 60; in fact, the action of the take-down member 60 on the textile product 5 affects, through the textile product 5 itself, the individual weft yarns 19. Therefore this factor too is to be taken into account in determining the amount of weft yarn 19 to be supplied to the threading tube 11, i.e. in calculating the first follow-up parameter PI1.

In the preferred embodiment of the invention, the first follow-up parameter PI1 is obtained from the following relations:

$$PI1=(PAR1+PAR2)*KI1$$

$$PAR1=ADD1+ADD2$$

$$ADD1=PS(i)-PS(i-1)$$

$$ADD2=PS(i)-PPOS1$$

$$(\text{or } ADD2=PS(i)-PPOS2)$$

wherein:

PI1 is the first follow-up parameter;

PAR1 is the first parameter, equal to ADD1+ADD2;

PAR2 is the second parameter;

KI1 is a prestored proportionality constant.

The first follow-up parameter PI1 calculated as above stated can take values included between 0 and 30000, both in case of use of brushless motors and in case of use of stepping motors; however, for a correct and reliable operation of the machine 1 and in particular of the first feeding member 20, it is suitable not to cause too sudden changes in the variations of the rotation speed of the output shaft 33 in motor 31 of the first actuator 30.

Therefore, the first calculation means 91 comprises a differentiating block 91*a* to calculate the difference between the first follow-up parameter PI1 of each record 110 and the first follow-up parameter of the following record; this difference is compared by appropriate comparator means 91*b* with a prestored threshold that can be conveniently put to 10000.

Should the threshold exceed the prestored threshold, correction means 91*c* carries out variation of the first follow-up parameter together with a predetermined number of preceding first follow-up parameters, so that said variation between consecutive first follow-up parameters is made less sudden.

In more detail, the correction means 91*c* selects a predetermined number of first follow-up parameters (3 for example) and linearly divides the above detected difference among them, so as to distribute the variation, that appeared to be too sharp, on several weft yarns 5*b*.

If, by way of example, a difference between a predetermined follow-up parameter PI1 and the subsequent one is considered to be equal to 27000, since a variation of such an amount between a weft row 5*b* and the subsequent one cannot be commanded to the first actuator 20, two intermediate values are calculated (9000 and 18000; the first one being obtained by dividing 2700 by 3 and the second one by multiplying the first result by 2) that are added to the predetermined first follow-up parameter PI1 and to the preceding first follow-up parameter.

In this way, between each weft row 5*b* and the subsequent one, the difference between the respective first follow-up parameters PI1 keeps always lower than the established threshold (equal to 10000), and the maximum value is gradually reached in the space of three weft rows 5*b*.

Obviously, also different connection techniques can be alternatively employed, based on more complex mathematic functions (generic splines for example), to obtain gradual variations in the case of first follow-up parameters much different from each other.

The first calculation means 91 is further provided with a modification block 91*d* which can carry out a further correction of the first follow-up parameter PI1 calculated as above described; this correction is carried out taking into account the elasticity of the weft yarn 19.

In particular, the modification is performed following the relation:

$$PI1'=PI1*(1-\text{elast }\%/200)$$

wherein PI1' is the first follow-up parameter PI1 after correction, PI1 is the first follow-up parameter before correction, elast % is the percent elasticity of the weft yarn 19.

The above correction obviously will not be of importance, should the elasticity of the weft yarn 19 be negligible.

A fourth field 112*d* of record 110 contains a second follow-up parameter PI2, associated with the weft row 5*b* corresponding to such a record 110 and representative of a follow-up ratio between the output shaft 53 of motor 51 of the second electromechanical actuator 50 and the main shaft 12.

For determining this second follow-up parameter PI2, controller 90 is provided with second calculation means 92 which generates a first and a second parameters P1, P2 contributing to definition of said second follow-up parameter PI2.

The first parameter P1 is representative of the amount of warp yarn 18 that is "requested" following the action of the take-down member 60; this member in fact by picking up the textile product 5 from the front grooved bar and supplying it to the exit, concurrently causes a drawing action carried out on the warp yarns 18 that are still to be interlaced with the weft yarns 19 for obtaining new portions of the textile product.

The effect caused by this drawing action is therefore kept into account, through said first parameter P1, in evaluating the amount of warp yarn 18 to be supplied to the eye-pointed needles 9.

In particular, the value of the first parameter P1 is expressed as the amount of warp yarn 18 drawn by the take-down member 60 at a rotation of 360° of the main shaft 12, when the follow-up ratio between the output shaft 73 of motor 71 and the main shaft 12 is unitary.

The second parameter P2 reveals the amount of warp yarn 18 that is supplied by the second feeding member 40 at a rotation of 360° of the main shaft 12, when the follow-up ratio between the output shaft 53 of motor 51 and the main shaft 12 is unitary.

In the preferred embodiment of the invention, the second follow-up parameter PI2 is a function of the ratio between the first and second parameters P1, P2 and, more particularly, the second follow-up PI2 is a function of the sum between the ratio of parameters P1 and P2 and an auxiliary parameter k_needles, representative of an amount of yarn drawn by a needle 7 at a movement of the same away from said guide bar 8.

In more detail, the second follow-up parameter PI2 is obtained by the relation:

$$PI2=KI2*[(P1/P2)+k_\text{needles}]$$

wherein

PI2 is the second follow-up parameter;

P1 is the first parameter;

P2 is the second parameter;

k_needles represents the amount of warp yarn drawn by each needle 7 during movement of same away from the guide bar;

KI2 is a prestored proportionality constant.

In more detail, the coefficient k_needles is proportional to the ratio between the stroke of needles 7 (in a displacement parallel to the longitudinal needle extension) and the amount of yarn supplied by the second feeding member 40 for each full rotation (of 360°) of rollers 41, 42, 43.

A fifth field 112*e* of record 110 contains a third follow-up parameter PI3 associated with the weft row 5*b* corresponding to such a record 110 and representative of a follow-up ratio between the output shaft 73 of motor 71 of the third electromechanical actuator 70 and the main shaft 12.

In order to determine the value of said third follow-up parameter PI3, the control apparatus 80 is provided with third calculation means 93; said means carries out calculation of the third follow-up parameter PI3 in such a manner that it is proportional to the density of stitches per centimeter as inputted by the operator.

In the light of the above, it is apparent that memory 100 of controller 90 has a logic structure quite similar to a table, in which each row is defined by a record 110 and holds all the parameters relating to knitting of a corresponding weft row of the textile product; on the other hand, each column holds an orderly sequence of parameters relating to a particular element of the machine or the textile product, each of which refers to a specific weft row 5*b*: the first column holds the main parameters 111 representative of the weft rows 5*b* and a sequential ordering of same, the second column holds the displacement parameters PS of the carrier slide bar 10, the third column holds the first follow-up parameters PI1, the fourth column holds the second follow-up parameters PI2 and the fifth column holds the third follow-up parameters PI3.

It will be appreciated that the first, second and third calculation means 91, 92, 93 can be incorporated into controller 90 and be therefore positioned close to the bed 2 and the relevant bars 6, 8, 10.

In this case, once insertion in controller 90 of the numeric chains defined by the succession of displacement parameters PS for the carrier slide bars 10 has occurred, controller 90 is able to determine in an independent manner and row by row, the value that the follow-up parameters PI1, PI2, PI3 must take.

Alternatively, the calculation means 91, 92, 93 can be incorporated in a computer, typically a personal computer (PC), placed at a remote position with respect to the machine bed 2, to the relevant bars 6, 8, 10 and the controller 90 associated therewith.

In this way, the computer which is tasked with the most complicated calculations can be positioned in a different place with respect to the mechanical components of the textile machine 1, thus avoiding the correct operation of the computer itself being impaired by vibrations generated by quick movements of bars 6, 8, 10 or dust formed following working of the different yarns.

The results generated by said computer can be transmitted to controller 90 to be stored in memory 100, through a telematic connection, or by means of a conventional magnetic or optical storage medium that is transferred from the computer to processor 0.90 by an operator.

Once the different displacement parameters PS and follow-up parameters PI1, PI2, PI3 have been set, the textile machine 1 can start operating to manufacture the textile product 5.

When the machine 1 and relevant control apparatus 80 are activated, scanning means 94 belonging to controller 90 carries out sequential reading of the main parameters 111 stored in each record 110 of memory 100; practically, the scanning means 94 selects records 110 one at a time following an orderly succession in such a manner that the parameters contained in each of them are employed for regulating operation of the machine 1.

In other words, when a record 110 is selected by the scanning means 94, the machine 1 performs a series of actuating steps of its members and/or working steps of the textile product 5 depending on the parameters contained in such a record 110; when reading and use of the parameters in such a record 110 has been completed, the scanning means 94 select the following record for a correct continuation of the machine operation.

In more detail, a reading block 95 detects the respective displacement parameter PS within the record 110 selected by the scanning means 94; this displacement parameter, in a manner known by itself and therefore not further described, is transmitted to an auxiliary actuator 99 active on the carrier slide bar 10 that causes said bar to carry out longitudinal movements depending on the received displacement parameter PS.

A first detecting block 96*a* carries out reading, within the same record 110, of the first follow-up parameter PI1 contained therein; a first transmitting block 96*b* connected with the first detecting block 96*a* and said sensor 13 sends the first follow-up parameter PI1 and the angular position PA of the main shaft 12 to the activation device 32 of the first actuator 30.

The activation device 32 of the first actuator 30 is provided with first comparator means 35 receiving the first follow-up parameter PI1 and the angular position PA of the main shaft 12 and comparing these two magnitudes.

Depending on this comparison, the first comparator means 35 then sends a first control signal 131 to motor 31 to set the output shaft 33 of motor 31 in rotation with a follow-up ratio with respect to the main shaft 12 that is defined by the first follow-up parameter PI1.

In addition to the above, the electric activation device 32 may comprise an auxiliary control block (not shown in the drawings) consisting of an encoder associated with the output shaft 33 of motor 31, and of a regulation circuit carrying out a feedback control on motor 31 depending on the information about the position of the output shaft 33 detected by said encoder.

Reading of the other parameters contained in said record 110 takes place in a quite similar manner.

In fact, controller 90 comprises a second detecting block 97*a* to detect the second follow-up parameter PI2 belonging to record 110; a second transmitting block 97*b* connected with the second detecting block 97*a* and with sensor 13 sends the second follow-up parameter PI2 and the angular position PA of the main shaft 12 to the activation device 52 of the second actuator 50.

The activation device 52 is provided with second comparator means 55 that, depending on the comparison between the second follow-up parameter PI2 and the angular position PA of the main shaft 12, transmits a second control signal 132 to motor 51 so that the output shaft 53 of said motor 51 is set in rotation with a follow-up ratio relative to the main shaft 12 that is defined by the second follow-up parameter PI2.

The electric activation device 52 too can be provided with en encoder and a regulation circuit connected therewith, to carry out a feedback control on the position and rotation speed of the output shaft 53 of motor 51.

To enable reading of the third follow-up parameter PI3 contained in record 110, controller 90 further comprises a third detecting block 98*a*; also provided is a third transmitting block 98*b* connected with the third detecting block 98*a* and with sensor 13.

The third transmitting block 98*b* sends the angular position PA of the main shaft 12 and the third follow-up parameter PI3 to the activation device 72 of the third actuator 70; the activation device 72 comprises third comparator means 75 that, following a comparison between the angular position PA of the main shaft 12 and the third follow-up parameter PI3, transmits a third control signal 133 to motor 71.

In this way, the output shaft 73 of motor 71 is driven in rotation with a follow-up ratio with respect to the main shaft 12 that is defined by the third follow-up parameter PI3.

In the same manner as above described with reference to the activation devices 32, 52 of the first and second actuators 30, 50, also the activation device 72 of the third actuator 70 may comprise an encoder and a regulation circuit operatively associated with motor 71 for a closed loop control of the position and rotation speed of the output shaft 73 of the motor 71 itself.

It is apparent that, concurrently with the above described operations, the needle bar 6 and guide bar 8 are suitably moved and the carrier slide bar 10 is submitted to reciprocating movements in a vertical direction too; these movements, being of known type and not essential for understanding the invention, are not herein described in detail.

The above description, as can be noticed, substantially relates to a single record 110 and the weft row 5*b* associated therewith; through a subsequent scanning carried out by the scanning means 94 the following records are then selected in succession.

It will be appreciated that, due to operation and control of the above described machine 1, tensioning variations in the weft yarn, warp yarns and drawing of the textile product 5 can be obtained without stopping operation of the machine 1, through sending of appropriate command signals to actuators 30, 50, 70.

In the light of the above, the control method of the textile machine 1 is performed in a manner as described herebelow.

First of all the angular position PA of the main shaft 12 which must be used as the reference for a synchronized movement of all members present in the machine 1 is detected.

Then calculation of the first, second and third follow-up parameters PI1, PI2, PI3 is carried out to define the follow-up ratio between the output shafts 33, 53, 73 of the first, second and third actuators 30, 50, 70, and the main shaft 12.

This calculation occurs for each of the weft rows 5*b* forming the textile product 5 so that, at each individual longitudinal movement of the carrier slide bar 10, each actuator 30, 50, 70 receives a command signal 121, 122, 123 for movement, row by row, of the respective output shaft 33, 53, 73.

In more detail, the first follow-up parameter PI1 is calculated on the basis of the relations:

$$PI1=(PAR1+PAR2)*KI1$$

$$PAR1=ADD1+ADD2$$

$$ADD1=PS(i)-PS(i-1)$$

$$ADD2=PS(i)-PPOS1$$

$$(\text{OR } ADD2=PS(i)-PPOS2).$$

As can be seen, to obtain the first follow-up parameter PI1 a difference between the displacement parameter PI(i) of the weft row 5*b* in question and the displacement parameter PS(i−1) of the preceding weft row is first calculated, so as to quantify the real displacement to which the carrier slide bar 10 has been submitted.

Then a second difference is calculated between the displacement parameter PS(i) and a prestored parameter PPOS1 or PPOS2 representative of the position of the first needle 7*a* or the second needle 7*b*; to understand the last mentioned operation, the description relating to the first calculation means 91*a* is to be considered.

The two differences define a first and a second addend ADD1, ADD2 respectively, that are summed up to obtain a first parameter PAR1. The first parameter PAR1 is in turn added to a second parameter PAR2, representative of the amount of weft yarn drawn by the take-down member 60 following the action exerted on the textile product 5.

The first follow-up parameter PI1 is proportional to the sum of the first and second parameters PAR1, PAR2.

The first follow-up parameter PI1 calculated as above stated can be submitted to some modifications in order to optimize operation of the machine 1 and quality of the obtained textile product 5.

A first correction can be executed taking into account the elasticity of the employed weft yarn 19 in accordance with the relation:

$$PI1'=PI1*(1-\text{elast }\%/200)$$

wherein PI1' represents the first follow-up parameter PI1 after correction, PI1 represents the first follow-up parameter before correction, elast % represents the percent elasticity of the weft yarn 19.

A second correction can be applied by evaluating the difference between each first follow-up parameter PI1 and the first subsequent follow-up parameter; should this difference be greater than a prestored threshold, it is possible to obtain such a variation gradually by distributing this difference on several follow-up parameters PI1.

In fact, in this case a predetermined number of first consecutive follow-up parameters PI1 is selected that immediately precede the parameter having the maximum (or minimum) value, i.e. the parameter determining the sudden variation that is to be avoided; to each selected parameter PI1 a corrective parameter is added. Each corrective parameter is a function of the difference between the first follow-up parameter and the subsequent first follow-up parameter; in particular, each correction parameter is proportional to said difference.

More particularly, each correction parameter is proportional to said difference, so that said maximum (or minimum) value is reached with a linear increase (or decrease) of the corrected follow-up parameters transmitted to the first actuator 30.

The first follow-up parameter PI1 together with the angular position PA of the main shaft 12 is incorporated into a first command signal 121 that is transmitted to said first comparator means 35 that after comparing these magnitudes with each other, generates a corresponding first control signal 131 for motor 31 of the first actuator 30.

The method further comprises a step of calculating the second follow-up parameter PI2 for regulation of the second actuator 50.

The second follow-up parameter PI2 is determined through the relation:

$$PI2=KI2*[(P1/P2)+k_\text{needles}]$$

wherein

PI2 is the second follow-up parameter;

P1 is the first parameter;

P2 is the second parameter;

k_needles represents the amount of warp yarn drawn by each needle 7 during the needle movement away from the eye-pointed needle; further details are set out above with reference to the same formula;

KI2 is a prestored proportionality constant.

As can be seen, the second follow-up parameter PI2 depends on the amount of warp yarn 18 drawn by the take-down member 60 following the action exerted on the textile product 5; this dependence is particularly expressed taking into account the amount of warp yarn 18 drawn by the take-down member 60 at a rotation of 360° of the main shaft 12, assuming that the follow-up ratio between rollers 61, 62, 63 of the take-down member 60 and the main shaft 12 is unitary.

The second follow-up parameter PI1 further depends on the amount of warp yarn 18 supplied by the second feeding member 40 for each revolution of the main shaft 12, when the follow-up ratio between rollers 41, 42, 43 of the second feeding member 40 and the main shaft 12 is unitary.

Therefore the first and second parameters P1, P2 are calculated that are representative of said amounts of warp yarn 18 drawn by the take-down member 60 and supplied by the second feeding member 40, and the second follow-up parameter PI2 is determined depending on the ratio between the first and second parameters P1, P2.

In addition, another factor to be taken into account is the amount of warp yarn 18 drawn by needles 7 during the longitudinal movement thereof; needles 7 in fact, as they move away from the eye-pointed needles 9 to close the respective knitting stitches exert a pulling action on the warp yarns 18 engaged by them.

Therefore, if parameter k_needles is summed up in calculating the second follow-up parameter PI2, motion of needles 7 is also taken into consideration for determining the amount of warp yarn 18 to be supplied through the second feeding member 40.

The second follow-up parameter PI2, together with the angular position PA of the main shaft 12 is incorporated into a second command signal 122 that is sent to the activation device 52 of the second actuator 50.

The comparator means 55 of the activation means 52, upon receiving the second command signal 122 and comparing the second follow-up parameter PI2 with the angular position PA of the main shaft 12, sends a control signal to motor 51 so that the output shaft 53 of motor 51 is set in rotation with a follow-up ratio defined by the second follow-up parameter PI2.

The method further comprises a step of calculating the third follow-up parameter PI3.

This third follow-up parameter PI3 is merely obtained as the product of a prestored data representative of the desired density of the stitches (expressed in stitches/centimeter) by a conversion factor that allows the obtained corresponding value to be transmitted to the third actuator 70, so that movement of the take-down member 60 capable of determining the requested stitches/centimeter density is obtained.

The third follow-up parameter PI3, together with the angular position PA of the main shaft 12 is incorporated into a third command signal 123 that is transmitted to the electric activation device 72 of the third actuator 70.

The third comparator means 75, upon reception of the third command signal 123, compares the angular position PA of the main shaft 12 and the third follow-up parameter PI3 with each other and outputs a corresponding third control signal 133 for motor 71, so that the output shaft 73 of said motor 71 is driven in rotation with a follow-up ratio, with respect to the main shaft 12, defined by the third follow-up parameter PI3.

While reference has been hitherto made to the textile machine 1 alone and the method of controlling it, the invention also extends to software programs, in particular programs for computers, stored on a suitable medium to put the invention into practice.

The program can be in the form of a source code, object code, partly source code and partly object code, as well as in the form of partly compiled formats, or any other form that can be employed to implement the method of the present invention.

For example, the medium may comprise storage means such as a ROM memory (a CD-ROM, a semiconductor ROM) or magnetic storage means (floppy disks or hard disks, for example).

In addition, the medium may be a carrier set for transmission such as an electric or optical signal that can be transmitted through electric or optical cables or radio signals.

When the program is incorporated in a signal that can be directly transmitted through a cable or device or equivalent means, the medium may consist of such a cable, device or equivalent means.

Alternatively, the medium may be an integrated circuit in which the program is incorporated, this integrated circuit being arranged to carry out or employ said method in accordance with the present invention.

The invention achieves important advantages.

First of all, by adjusting the work speed of the first feeding member, in particular depending on the width of the carrier slide bar movements, a textile product can be obtained that has optimal aesthetic features, in which each weft row is defined by a yarn amount really equal to the required amount to follow-up the threading tube in its movements.

In addition, by adjusting tensioning of the warp yarns when they are fed to the guide bar, the width of each warp chain can be varied thereby enabling use of weft yarns of different diameters at different points of the fabric.

Another advantage resides in that, by suitably combining the variations in the rotation speeds of the first and second feeding members and the take-down member, particular "special" effects can be obtained in the finished product, that are for example due to alternating thinner portions with more compact portions, to shrinkage and enlargement effects resulting from varying the weft yarn supplied row by row, etc.

In addition, the control carried out on machine 1 is very precise thanks to the above described electronic control means ensuring precision and accuracy in all adjustments.

Furthermore, when with the same machine two textile products different from each other are wished to be manufacture in succession, change of the control inputs when the first product has been completed is substantially immediate, since it is sufficient to load a new succession of suitably set and prestored data (from a memory or through a magnetic storage medium, for example).

In addition to the above, by virtue of the simplicity of the operations to be performed for the machine setup, said operations can be carried out by unqualified staff too.

Another advantage comes out with reference to the step of studying new products or fabrics, during which several attempts are to be made and the modalities of operation of the machine are to be correspondingly varied: since these variations are obtained by merely operating on parameters inputted through said electronic control means, very reduced times are required for obtaining the desired product.

What is claimed is:

1. A textile machine comprising:

at least one needle bar (6) carrying a plurality of needles (7) in alignment between a first and a second needle **(7*a*, 7*b*)**;

at least one guide bar (8) carrying a plurality of eye-pointed needles (9);

at least one carrier slide bar (10) carrying a plurality of threading tubes (11);

a main shaft (12) associated with said bars (6, 7, 8) for synchronized movements of same and manufacture of a textile product (5), the latter being defined by an orderly succession of weft rows **(5*b*)** interlaced with a plurality of warp chains;

a first feeding member (20) to feed at least one weft yarn (19) to said threading tubes (11);

a second feeding member (40) to feed a plurality of warp yarns (18) to said eye-pointed needles (9);

a member (60) to take down said textile product (5);

a control apparatus (80) equipped with:

at least one first electromechanical actuator (30), operatively active on said first or second feeding member (20, 40) or said take-down member (60) for movement of same;

a controller (90) for regulation of at least said first actuator (30).

2. The textile machine as claimed in claim 1, wherein said control apparatus (80) further comprises a sensor (13) associated with said main shaft (12) to detect an angular position (PA) of said main shaft (12) and transmit said angular position (PA) to said controller (90).

3. The textile machine as claimed in claim 2, wherein said first actuator (30) comprises:

an electric motor (31) having an output shaft (33) drivable in rotation for movement of said first or second feeding members (20, 40), or said take-down member (60);

an electric activation device (32) to power and control said motor (31).

4. The textile machine as claimed in claim 3, wherein said controller (90) comprises a first transmitting block **(96*b*) connected with said sensor (13) to receive the angular position (PA) of said main shaft (12) and connected with said activation device (32) to transmit to the latter a first command signal (121) incorporating said angular position (PA) and a first follow-up parameter (111) representative of a follow-up ratio between the output shaft (33) of said motor (31) and said main shaft (12), the activation device (32) of said first actuator (30) being provided with first comparator means (35), to compare said angular position (PA) and first follow-up parameter (PI1) with each other and generate a corresponding first control signal (131) for said motor (31)**.

5. The textile machine as claimed in claim 3, wherein the output shaft (33) of said electric motor (31) is connected with said first feeding member (30) to adjust tensioning of said weft yarn (19) between said first feeding member (30) and a respective threading tube (11) of said carrier slide bar (10).

6. The textile machine as claimed in claim 5, wherein said first feeding member (20) comprises:

a first roller (21) drivable in rotation by said electric motor (31);

a second roller (22) idly mounted on a respective rotation axis and disposed close to said first roller (21) to engage said weft yarn (19) and feed it to said respective threading tube (11), a third roller (23) drivable in rotation by said electric motor (31) and disposed close to said second roller (22).

7. The textile machine as claimed in claim 4, wherein said controller (90) comprises a memory (100) having an orderly sequence of records (110), each associated with a corresponding weft row **(5*b*) of said textile product (5)** and having:

a first field **(112*a*) containing a main parameter (111) representative of a corresponding weft row (5*b*)**;

a second field **(112*b*) containing a displacement parameter (PS) representative of a longitudinal displacement of said carrier slide bar (10) carried out at the weft row (5*b*) identified by said main parameter (111)**;

a third field **(112*c*) containing a first follow-up parameter (PI1), associated with the weft row (5*b*) identified by said main parameter (111) and representative of a follow-up ratio between the output shaft (33) of said motor (31) and said main shaft (12)**.

8. The textile machine as claimed in claim 7, wherein said controller (90) further comprises:

scanning means (84) to sequentially read the main parameters (111) stored in said memory (100);

a reading block (95) to detect, at each main parameter (111), the respective displacement parameter (PS) and transmit the latter to an auxiliary actuator (99), for a longitudinal movement of said carrier slide bar (10) depending on said displacement parameter (PS);

a first detecting block (96*a*) to detect, at each main parameter (111), the respective first follow-up parameter PI1) and transmit the latter to the first comparator means (35) of the electric activation device (32) of said first electromechanical actuator (30).

9. The textile machine as claimed in claim 7, wherein said control apparatus (80) further comprises first calculation means (91) to calculate the first follow-up parameter (PI1) of a preestablished record (110*a*) depending on the displacement parameter (PS(i)) belonging to said preestablished record (110*a*).

10. The textile machine as claimed in claim 9, wherein said first calculation means (91) is further provided with:

a differentiating block (91*a*) to calculate a difference between the first follow-up parameter (PI1) belonging to said preestablished record (110*a*) and a first follow-up parameter belonging to an adjacent and subsequent record (110);

comparator means (91*b*) to compare said difference with a preestablished threshold;

correction means (91*c*) to vary said first follow-up parameter (PI1) depending on said comparison.

11. The textile machine as claimed in claim 9, wherein said first calculation means (91) further comprises a modification block (91*d*) to vary said first follow-up parameter (PI1) depending on the elasticity of said weft yarn (19).

12. The textile machine as claimed in claim 7, wherein said control apparatus (80) further comprises a second electromechanical actuator (50) provided with:

an electric motor (51) having an output shaft (53) drivable in rotation and connected with said second feeding member (40) for moving the latter and adjusting tensioning of said warp yarns (18) between said second feeding member (40) and said carrier slide bar (8);

an electric activation device (52) for powering and controlling said motor (51).

13. The textile machine as claimed in claim 12, wherein said second feeding member (40) comprises:

a first roller (41) drivable in rotation by the electric motor (51) of said second actuator (50);

a second roller (42) idly mounted on a respective rotation axis and disposed close to said first roller (41) to engage said warp yarns (18) and feed them to said eye-pointed needles (9);

a third roller (43) drivable in rotation by the electric motor (51) of said second actuator (50) and disposed close to said second roller (42).

14. The textile machine as claimed in claim 12, wherein each record (110) of the memory (100) of said controller (90) further has a fourth field (112*d*) containing a second follow-up parameter (PI2), associated with the weft row (5*b*) identified by the main parameter (111) of said record (110) and representative of a follow-up ratio between the output shaft (53) of the motor (51) of said second actuator (50) and said main shaft (12).

15. The textile machine as claimed in claim 14, wherein said controller (90) further comprises:

a second detecting block (97*a*) to detect, at each main parameter (111), the respective second follow-up parameter (PI2);

a second transmission block (97*b*) connected with said second detecting block (97*a*) and said sensor (13) to transmit a second command signal (122) incorporating the angular position (PA) of said main shaft (12) and said second follow-up parameter (PI2) to the activation device (52) of said second actuator (50), the activation device (52) of said second actuator (50) being provided with second comparator means (55) to compare said angular position (PA) and second follow-up parameter (PI2) with each other and output a corresponding second control signal (132) for the motor (51) of said second actuator (50).

16. The textile machine as claimed in claim 15, wherein said control apparatus (80) further comprises second calculation means (92) to calculate said second follow-up parameter (PI2), the latter being a function of a first parameter (P1) revealing an amount of warp yarn (18) drawn by said take-down member (60) for each revolution of said main shaft (12) at a unitary follow-up ratio between said take-down member (60) and said main shaft (12) and of a second parameter (P2) revealing an amount of warp yarn (18) supplied by said second feeding member (40) for each revolution of said main shaft (12) at a unitary follow-up ratio between the output shaft (53) of said electric motor (51) and said main shaft (12).

17. The textile machine as claimed in claim 7, wherein said control apparatus (80) further comprises a third electromechanical actuator (70) provided with:

an electric motor (71) having an output shaft (73) drivable in rotation and connected with said take-down member (60) to move the latter and adjust a pulling tension of said textile product (5);

an electric activation device (72) to power and control said motor (71).

18. The textile machine as claimed in claim 17, wherein said take-down member (60) comprises:

a first roller (61) drivable in rotation by the electric motor (71) of said third actuator (70), a second roller (62) idly mounted on a respective rotation axis and disposed close to said first roller (61) to draw said textile product (5) and supply it to the exit of said machine (1), a third roller (63), drivable in rotation by the electric motor (71) of said third actuator (70) and disposed close to said second roller (62).

19. The textile machine as claimed in claim 18, wherein each record (110) of the memory (100) of said controller (90) further has a fifth field (112*e*) containing a third follow-up parameter (PI3) associated with the weft row (5*b*) identified by the main parameter (111) of said record (110) and representative of a follow-up ratio between the output shaft (73) of the electric motor (71) of said third actuator (70) and said main shaft (12).

20. The textile machine as claimed in claim 19, wherein said controller (90) further comprises:

a third detecting block (98*a*) to detect at each main parameter (111), the respective third follow-up parameter (PI3);

a third transmission block (98*b*) connected with said third detecting block (98*a*) and said sensor (12) to transmit a third command signal (123) incorporating the angular position (PA) of said main shaft (12) and said third follow-up parameter (PI3) to the activation device (72) of said third actuator (70);

the activation device (72) of said third actuator (70) being provided with third comparator means (75) to compare said angular position (PA) and third follow-up parameter (PI3) with each other and output a corresponding third control signal (133) for the motor (71) of said third electromechanical actuator (70).

21. The textile machine as claimed in claim 20, wherein said control apparatus (80) further comprises third calculation means (93) to calculate said third follow-up parameter (PI3), the latter being directly proportional to a rotation speed of the output shaft (73) of the motor (71) of said third actuator (70) and to a previously inputted parameter representative of a density of the weft rows per length unit of said textile product (5).

22. A method of controlling a textile machine, said textile machine (1) being equipped with:

at least one needle bar (6) carrying a plurality of needles (7) in alignment between a first and a second needle (7*a*, 7*b*);

at least one guide bar (8) carrying a plurality of eye-pointed needles (9);

at least one carrier slide bar (10) carrying a plurality of threading tubes (11);

a main shaft (12) associated with said bars (6, 7, 8) for synchronized movements of same and manufacture of a textile product (5), the latter being defined by an orderly succession of weft rows (5*b*) interlaced with a plurality of warp chains;

a first feeding member (20) to feed said threading tubes (11) with at least one weft yarn (19);

a second feeding member (40) to feed said eye-pointed needles (9) with a plurality of warp yarns (18);

a take-down member (60) to draw said textile product (5);

a first electromechanical actuator (30), operatively active on said first feeding member (20) for movement of same;

a second electromechanical actuator (50), operatively active on said second feeding member (40) for movement of same;

a third electromechanical actuator (70), operatively active on said take-down member (60) for movement of same;

said method comprising the following steps:

driving said main shaft (12) in rotation;

moving said bars (6, 8, 10) in synchronism with said main shaft (12) to obtain said textile product (5);

for each weft row (5*b*) of said textile product (5), sending a first command signal (121) to said first electromechanical actuator (30) for a controlled movement of said first feeding member (20).

23. The method as claimed in claim 22, wherein the step of sending said first command signal (121) comprises:

detecting an angular position (PA) of said main shaft (12);

calculating a first follow-up parameter (PI1) representative of a follow-up ratio between an output shaft (33) of said first electromechanical actuator (30) and said main shaft (12);

sending the angular position (PA) of said main shaft (12) and said first follow-up parameter (PI1) to an activation device (32) of said first electromechanical actuator (30), said first command signal (121) incorporating said angular position (PA) and said first follow-up parameter (PI1);

receiving said first command signal (121);

comparing said angular position (PA) and said first follow-up parameter (PI1) with each other;

sending a corresponding first control signal (131) to a motor (31) of said first actuator (30) depending on said comparison.

24. The method as claimed in claim 23, wherein the step of calculating said first follow-up parameter (PI1) comprises:

calculating a first parameter (PAR1) depending on a displacement parameter (PS) revealing a longitudinal movement of said carrier slide bar (10);

calculating a second parameter (PAR2) depending on a movement of said take-down member (60);

summing up said first and second parameters (PAR1, PAR2).

25. The method as claimed in claim 24, wherein the step of calculating said first parameter (PAR1) comprises:

calculating a first difference between the displacement parameter (PS(i)) associated with a predetermined weft row (5*b*) of said textile product (5) and the displacement parameter (PS(i−1)) associated with a preceding weft row adjacent to said predetermined weft row (5*b*);

calculating a first addend (ADD1) representative of said first difference;

calculating a second difference between said displacement parameter (PS(i)) and a parameter representative of a position of said first or second needle (7*a*, 7*b*);

calculating a second addend (ADD2), depending on said second difference;

summing up said first and second addends (ADD1, ADD2).

26. The method as claimed in claim 23, further comprising a first correction step to correct the first follow-up parameter (PI1) associated with said predetermined weft row (5*b*) depending on a difference between the first follow-up parameter (PI1) associated with a predetermined weft row (5*b*) and the first follow-up parameter associated with a subsequent weft row with respect to said predetermined weft row (5*b*).

27. The method as claimed in claim 23 further comprising a second correction step of said first follow-up parameter (PI1) to correct said first follow-up parameter. (PI1) depending on an elasticity of said weft yarn (19).

28. The method as claimed in claim 22 further comprising:

for each weft row (5*b*) of said textile product (5), sending a second command signal (122) to said second electromechanical actuator (50) for a controlled movement of said second feeding member (40).

29. The method as claimed in claim 28 wherein the step of sending said second command signal (122) comprises:

detecting an angular position (PA) of said main shaft (12);

calculating a second follow-up parameter (PI2) representative of a follow-up ratio between an output shaft (53) of said second electromechanical actuator (50) and said main shaft (12);

sending the angular position (PA) of said main shaft (12) and said second follow-up parameter (PI2) to an activation device (52) of said second electromechanical actuator (50), said second command signal (122) incorporating said angular position (PA) and said second follow-up parameter (PI2);

receiving said second command signal (122);

comparing said angular position (PA) and second follow-up parameter (PI2) with each other;

sending a corresponding second control signal (132) to a motor (51) of said second actuator (50) depending on said comparison.

30. The method as claimed in claim 29, wherein the step of calculating said second follow-up parameter (PI2) comprises:

calculating a first parameter (P1) revealing an amount of warp yarn (18) drawn from said take-down member (60) for each rotation of said main shaft (12) at a unitary follow-up ratio between said take-down member and main shaft (12);

calculating a second parameter (P2) revealing an amount of warp yarn (18) supplied by said second feeding member (40) for each revolution of said main shaft (12) at a unitary follow-up ratio between the output shaft of the electric motor (51) of said second actuator (50) and said main shaft (12);

said second follow-up parameter (PI2) being a function of said first and second parameters (P1, P2).

31. The method as claimed in claim 22 further comprising:

for each weft row (5*b*) of said textile product (5), sending a third command signal (123) to a third electromechanical actuator (70) for a controlled movement of said take-down member (60).

32. The method as claimed in claim 31, wherein the step of sending said third command signal (123) comprises:

detecting an angular position (PA) of said main shaft (12);

calculating a third follow-up parameter (PI3) representative of a follow-up ratio between an output shaft (73) of a third electromechanical actuator (70) and said main shaft (12);

sending the angular position (PA) of said main shaft (12) and said third follow-up parameter (PI3) to an activation device (72) of said third electromechanical actuator (70), said third command signal (123) incorporating said angular position (PA) and said third follow-up parameter (PI3);

receiving said third command signal (123);

comparing said angular position (PA) and third follow-up parameter (PI3) with each other;

sending a corresponding third control signal (133) to a motor (71) of said third actuator (70) depending on said comparison.

33. A method of controlling a textile machine, said textile machine (1) being equipped with:

at least one needle bar (6) carrying a plurality of needles (7) in alignment between a first and a second needle (7*a*, 7*b*);

at least one guide bar (8) carrying a plurality of eye-pointed needles (9);

at least one carrier slide bar (10) carrying a plurality of threading tubes (11);

a main shaft (12) associated with said bars (6, 7, 8) for synchronized movements of same and manufacture of a textile product (5), the latter being defined by an orderly succession of weft rows (5*b*) interlaced with a plurality of warp chains;

a first feeding member (20) to feed said threading tubes (11) with at least one weft yarn (19);

a second feeding member (40) to feed said eye-pointed needles (9) with a plurality of warp yarns (18);

a take-down member (60) to draw said textile product (5);

a first electromechanical actuator (30), operatively active on said first feeding member (20) for movement of same;

a second electromechanical actuator (50), operatively active on said second feeding member (40) for movement of same;

a third electromechanical actuator (70), operatively active on said take-down member (60) for movement of same;

said method comprising the following steps:

driving said main shaft (12) in rotation;

moving said bars (6, 8, 10) in synchronism with said main shaft (12) to obtain said textile product (5);

for each waft row (5*b*) of said textile product (5), sending a second command signal (122) to said second electromechanical actuator (50) for a controlled movement of said second feeding member (40).

34. A method of controlling a textile machine, said textile machine (1) being equipped with:

at least one needle bar (6) carrying a plurality of needles (7) in alignment between a first and a second needle (7*a*, 7*b*);

at least one guide bar (8) carrying a plurality of eye-pointed needles (9);

at least one carrier slide bar (10) carrying a plurality of threading tubes (11);

a main shaft (12) associated with said bars (6, 7, 8) for synchronized movements of same and manufacture of a textile product (5), the latter being defined by an orderly succession of weft rows (5*b*) interlaced with a plurality of warp chains;

a first feeding member (20) to feed said threading tubes (11) with at least one waft yarn (19);

a second feeding member (40) to feed said eye-pointed needles (9) with a plurality of warp yarns (18);

a take-down member (60) to draw said textile product (5);

a first electromechanical actuator (30), operatively active on said first feeding member (20) for movement of same;

a second electromechanical actuator (50), operatively active on said second feeding member (40) for movement of same;

a third electromechanical actuator (70), operatively active on said take-down member (60) for movement of same;

said method comprising the following steps:

driving said main shaft (12) in rotation;

moving said bars (6, 8, 10) in synchronism with said main shaft (12) to obtain said textile product (5);

for each weft row (5*b*) of said textile product (5), sending a third command signal (123) to said third electromechanical actuator (70) for a controlled movement of said take down member (60).

* * * * *